US012207750B1

(12) United States Patent
Hecht et al.

(10) Patent No.: US 12,207,750 B1
(45) Date of Patent: Jan. 28, 2025

(54) CURTAIN ASSEMBLY

(71) Applicant: MILLERKNOLL, INC., Zeeland, MI (US)

(72) Inventors: Samuel Hecht, London (GB); Kimberlee Colin, London (GB); Leo Leitner, London (GB); Luca Corvatta, London (GB); Michael Katje, Grand Haven, MI (US); Emma Elaine Smalley, Cheboygan, MI (US); John Matthai, Holland, MI (US)

( * ) Notice: Subject to any disclaimer, the term of this patent is extended or adjusted under 35 U.S.C. 154(b) by 0 days.

(21) Appl. No.: 18/468,462

(22) Filed: Sep. 15, 2023

(51) Int. Cl.
*A47H 1/02* (2006.01)
*A47H 1/022* (2006.01)
*A47H 1/14* (2006.01)

(52) U.S. Cl.
CPC ..... *A47H 1/022* (2013.01); *A47H 1/14* (2013.01); *A47H 2001/0205* (2013.01)

(58) Field of Classification Search
CPC .. A47H 1/022; A47H 1/14; A47H 2001/0205; A47H 21/00; A47H 13/00; A47H 23/04; A47H 2023/025
USPC ..... 160/350
See application file for complete search history.

(56) References Cited

U.S. PATENT DOCUMENTS

| | | | | |
|---|---|---|---|---|
| 2,104,416 | A * | 1/1938 | De Ment | A47G 5/00 135/87 |
| 5,472,102 | A * | 12/1995 | Clayton | A47H 1/122 248/265 |
| 5,657,808 | A * | 8/1997 | Lin | A47H 13/00 160/385 |
| 6,499,528 | B1 * | 12/2002 | Johnson | A47H 1/18 160/351 |
| 11,428,043 | B2 * | 8/2022 | Chuang | E06B 9/367 |
| 2020/0149346 | A1 * | 5/2020 | Solomaniuck | A47H 23/01 |

OTHER PUBLICATIONS

Abstracta, "Scala Floor Screen," <https://abstracta.se/product/scala-floor/> web page visited Dec. 7, 2023 (8 pages).
Abstracta, "Scala," brochure available at least as early as Sep. 7, 2022 (10 pages).
Abstracta, "Scala Floor Screen," assembly instructions available at least as early as Sep. 7, 2022 (1 page).

* cited by examiner

*Primary Examiner* — Ko H Chan

(57) ABSTRACT

A curtain assembly includes a vertical support and a top cap coupled to the vertical support and defining an interior volume. The top cap includes a first end, a second end opposite the first end, and a plate. The plate has an upper side at least partially defining the interior volume, a lower side opposite the upper side, and a slot extending at least partially between the first and second ends. The curtain assembly further includes a curtain including an upper edge extending through the slot of the plate such that the upper edge is positioned within the interior volume of the top cap. The curtain also includes a lower portion hanging from the plate.

20 Claims, 10 Drawing Sheets

CURTAIN ASSEMBLY

FIELD OF THE INVENTION

The present invention relates to a curtain assembly, and more particularly a freestanding curtain assembly.

BACKGROUND OF THE INVENTION

Curtains may be provided in professional settings, educational settings, and residential settings to serve as partitions to create smaller private spaces.

SUMMARY OF THE INVENTION

The present invention provides, in one aspect, a curtain assembly including a vertical support and a top cap coupled to the vertical support and defining an interior volume. The top cap includes a first end, a second end opposite the first end, and a plate. The plate has an upper side at least partially defining the interior volume, a lower side opposite the upper side, and a slot extending at least partially between the first and second ends. The curtain assembly further includes a curtain including an upper edge extending through the slot of the plate such that the upper edge is positioned within the interior volume of the top cap. The curtain also includes a lower portion hanging from the plate.

The present invention provides, in another aspect, a curtain assembly including a vertical support and a top cap coupled to the vertical support. The top cap includes a first end, a second end opposite the first end, and a slot extending at least partially between the first and second ends. The curtain assembly further includes a curtain including an upper edge extending through the slot of the top cap and a lower portion hanging from the top cap. Moreover, the curtain assembly includes a brace coupled to the upper edge of the curtain and positioned within the top cap to secure the curtain to the top cap and hang the lower portion of the curtain from the top cap.

The present invention provides, in another aspect, a curtain assembly including a base configured to be placed on a surface and support the curtain assembly, and a vertical support having a first end and a second end opposite the first end, the second end being coupled to the base. The curtain assembly further includes a top cap coupled to the first end of the vertical support and defining an interior volume. The top cap includes a first plate, a second plate spaced from the first plate, and an outer periphery coupled to and disposed between the first plate and the second plate to define the interior volume. The second plate has a slot with an undulating configuration. Moreover, the curtain assembly includes a curtain including an upper edge extending through the slot of the second plate such that the upper edge is positioned within the interior volume of the top cap. The curtain also includes a lower portion hanging from the second plate.

Other aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
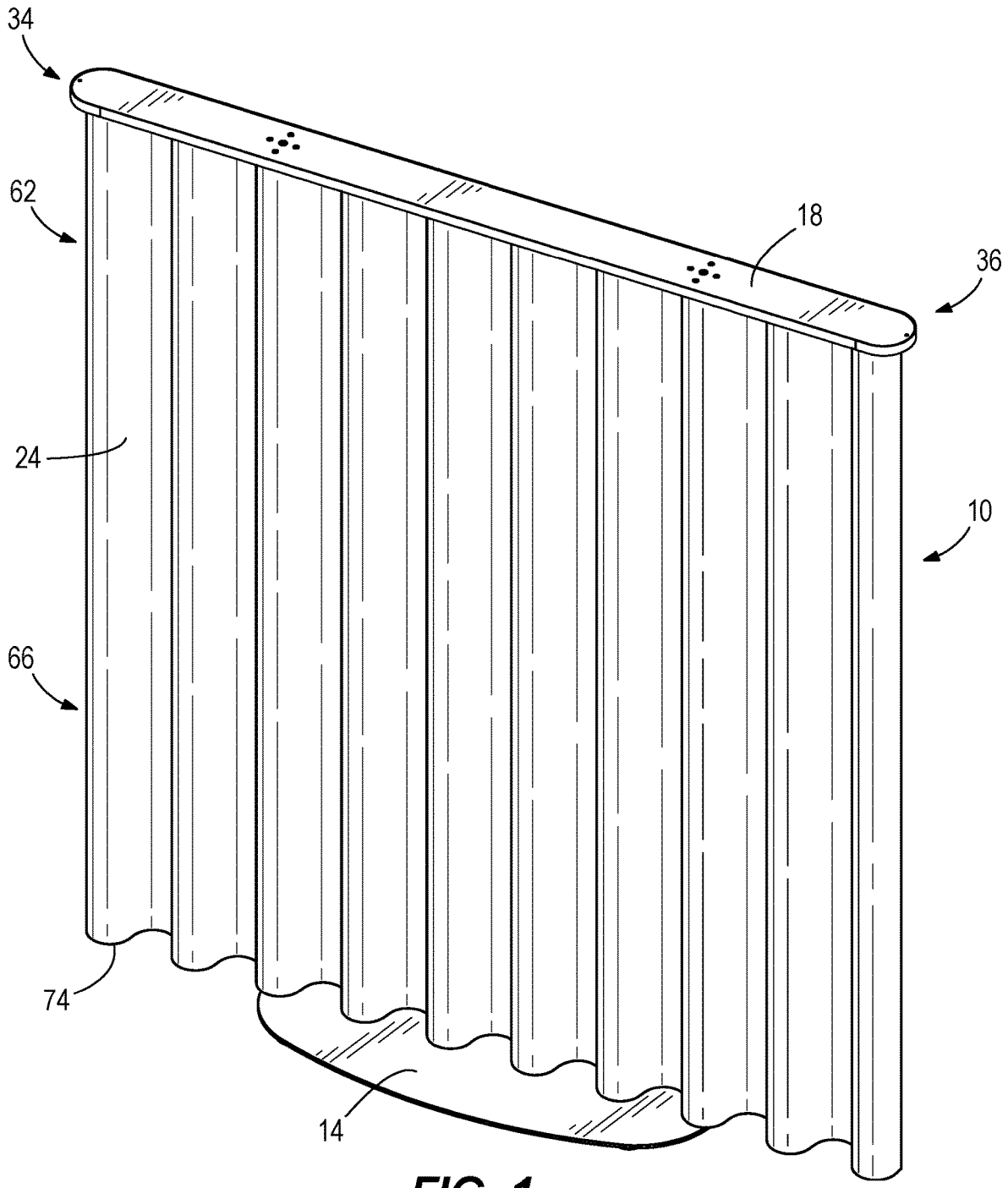
FIG. 1 is a perspective view of a curtain assembly according to an embodiment of the present invention.
Figure 2:
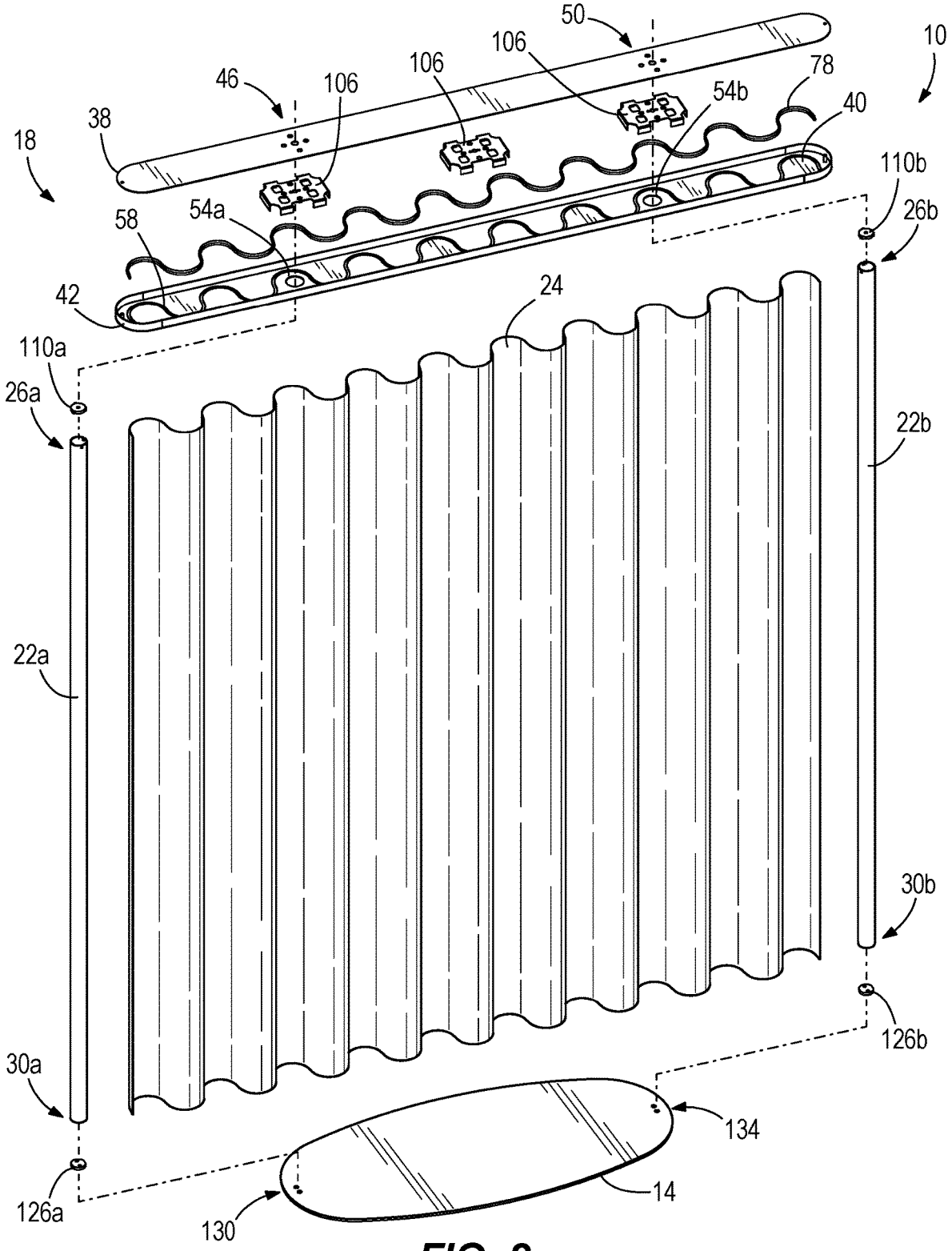
FIG. 2 is an exploded view of the curtain assembly of FIG. 1.
Figure 3:
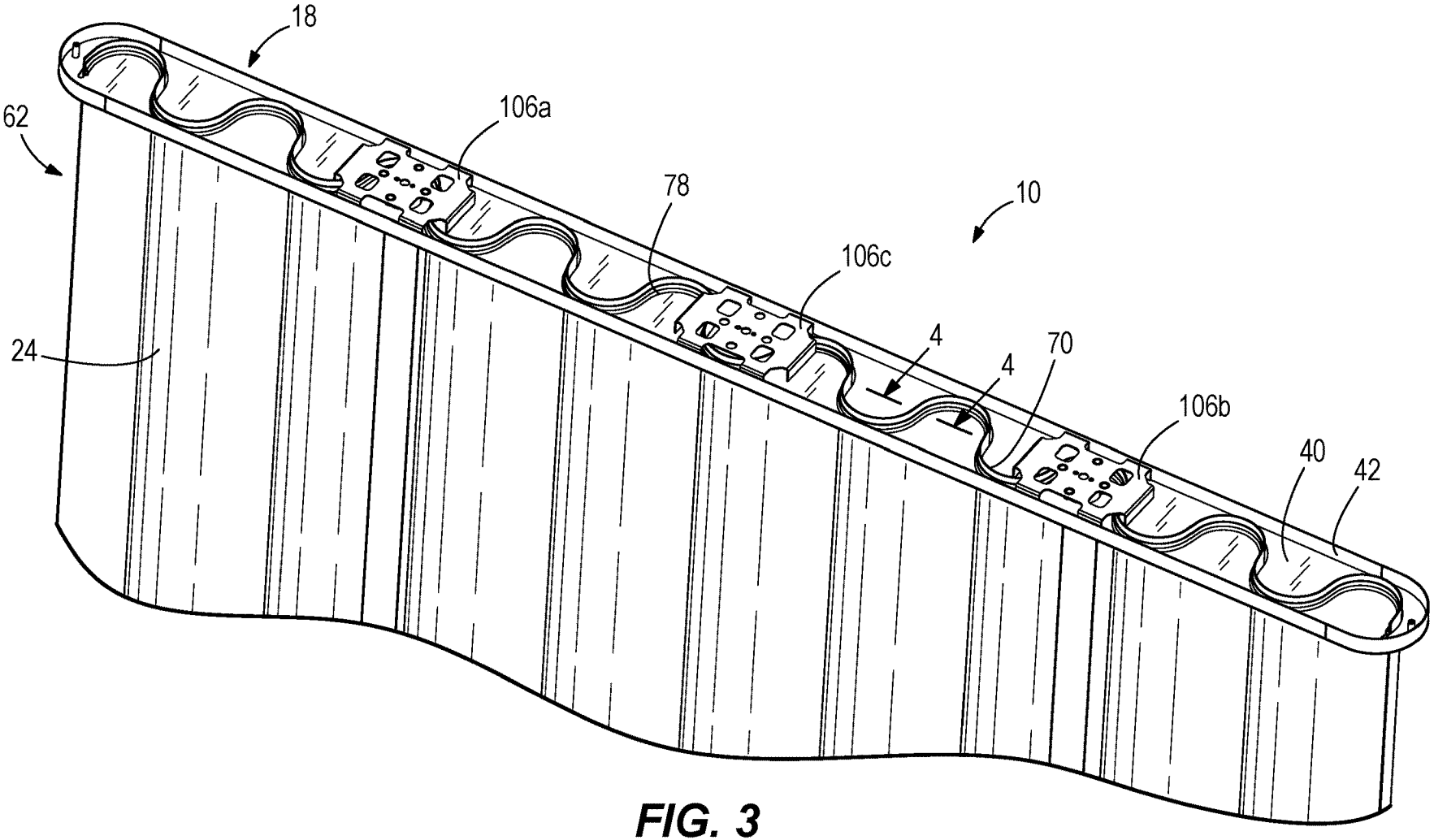
FIG. 3 is an enlarged view of the curtain assembly of FIG. 1 with portions removed.

FIGS. 1 and 2 illustrate a curtain assembly 10. The curtain assembly 10 includes a base 14, a top cap 18, a pair of vertical supports 22*a*, 22*b*, and a curtain 24. The illustrated base 14 is a metal plate with an obround shape. In other embodiments, the base 14 may have other shapes and/or be formed of other materials. In some embodiments, the base 14 may include separate, discrete components that together form the base 14 (e.g., two or more plates). The base 14 is configured to be placed on a surface (e.g., a floor) and support the curtain assembly 10.

The illustrated curtain assembly 10 includes two vertical supports 22*a*, 22*b*. In other embodiments, the curtain assembly 10 may include one or more vertical supports 22*a*, 22*b*, depending on the size of the curtain assembly 10. Each vertical support 22*a*, 22*b* has a first end 26*a*. 26*b* and a second end 30*a*, 30*b* opposite the first end 26*a*, 26*b*. The first end 26*a*, 26*b* of each vertical support 22*a*, 22*b* is coupled to the top cap 18. The second end 30*a*, 30*b* of each vertical support 22*a*, 22*b* is coupled to the base 14. As such, the vertical supports 22*a*, 22*b* support the top cap 18 above the base 14. The vertical supports 22*a*, 22*b* are spaced apart from each other, thereby forming a gap therebetween. In addition, the illustrated vertical supports 22*a*, 22*b* are metal rods. In other embodiments, the vertical supports 22*a* 22*b* may have other shapes and/or be formed of other materials.

With reference to FIGS. 1-3 and 7, the illustrated top cap 18 includes a first end 34, a second end 36, a first plate 38, a second plate 40, and an outer periphery 42. The top cap 18 has a linear shape. The first plate 38 may also be referred to as a top plate, and the second plate 40 may also be referred to as a bottom plate. In the illustrated embodiment, the first and second plates 38, 40 each has an obround shape. In other embodiments, the first and second plate 38, 40 may have other shapes. The outer periphery 42 is coupled to and disposed between the first and second plates 38, 40. As such, the first plate 38, the second plate 40, and the outer periphery 42 define an interior volume of the top cap 18. The first plate 38 is removably coupled to the outer periphery 42, thereby allowing access to the interior volume of the top cap 18.

As shown in FIG. 2, the first plate 38 has a first plurality of fastening holes 46 and a second plurality of fastening holes 50 spaced from the first plurality of fastening holes 46. The first and second plurality of fastening holes 46, 50 each include a central hole surrounded by four holes. The second plate 40 has a first hole 54*a* configured to receive a first of the vertical supports 22*a* and a second hole 54*b* configured to receive a second of the vertical supports 22*b*. As such, the first end 26*a*, 26*b* of each vertical support 22*a*, 22*b* is positioned within the interior volume of the top cap 18 as a respective vertical support 22*a*, 22*b* extends through the first and second holes 54*a*, 54*b* of the second plate 40. The second plate 40 further includes a slot 58 extending at least partially between the first end 34 and the second end 36 of the top cap 18. In the illustrated embodiment, the slot 58 extends almost entirely between the first end 34 and the second end 36. In some embodiments, the slot 58 may extend at least halfway or along a majority between the first end 34 and the second end 36. The slot 58 has a shape corresponding to the desired shape of the curtain 24. In particular, the illustrated slot 58 has a wavy (i.e., undulated) configuration. In other embodiments, the slot 58 may have other configurations, such as a linear configuration, a square wave configuration, an irregular configuration, or the like.

With reference to FIGS. 1-4, the curtain 24 includes an upper portion 62 and a lower portion 66. The upper portion 62 defines an upper edge 70 of the curtain 24 that is adjacent the top cap 18, and the lower portion 66 defines a lower edge 74 of the curtain 24 that is adjacent the base 14. When the curtain assembly 10 is assembled, the upper portion 62 extends through the slot 58 of the second plate 40 such that the upper edge 70 is disposed within the interior volume of the top cap 18. In the illustrated embodiment, the curtain 24 has a ripple fold header. In other embodiments, the curtain 24 can have a wave header or a flat panel header. In addition, the curtain 24 can be made of an opaque fabric, a sheer fabric, or any other desired fabric.

The curtain assembly 10 further includes a brace 78. The brace 78 may also be referred to as a flexible strip. The illustrated brace 78 has an enlarged portion 82 and a narrow portion 86 extending from the enlarged portion 82. In the illustrated embodiment, the enlarged portion 82 is a cylindrical portion, and the narrow portion 86 is a planar portion. The brace 78 is a continuous plastic extrusion component configured to be coupled to the upper edge 70 of the curtain 24 and extend along the entire width of the curtain 24. In some embodiments, the brace 78 may be discontinuous (e.g., formed of multiple, discrete extrusion components). As such, the brace 78 may be formed by a plastic extrusion process. To couple the brace 78 to the curtain 24, the brace 78 may be welded to the upper edge 70 of the curtain 24. Specifically, one side of the brace 78 may be welded to the upper edge 70, while an opposite side of the brace 78 remains exposed. In other embodiments, the brace 78 may be secured to the curtain 24 by other means, such as adhesives, sewing, fasteners (e.g., rivets, staples, etc.), and the like. Once coupled to the brace 78, the upper edge 70 of the curtain 24 conforms to the shape of the brace 78.

Figure 4:
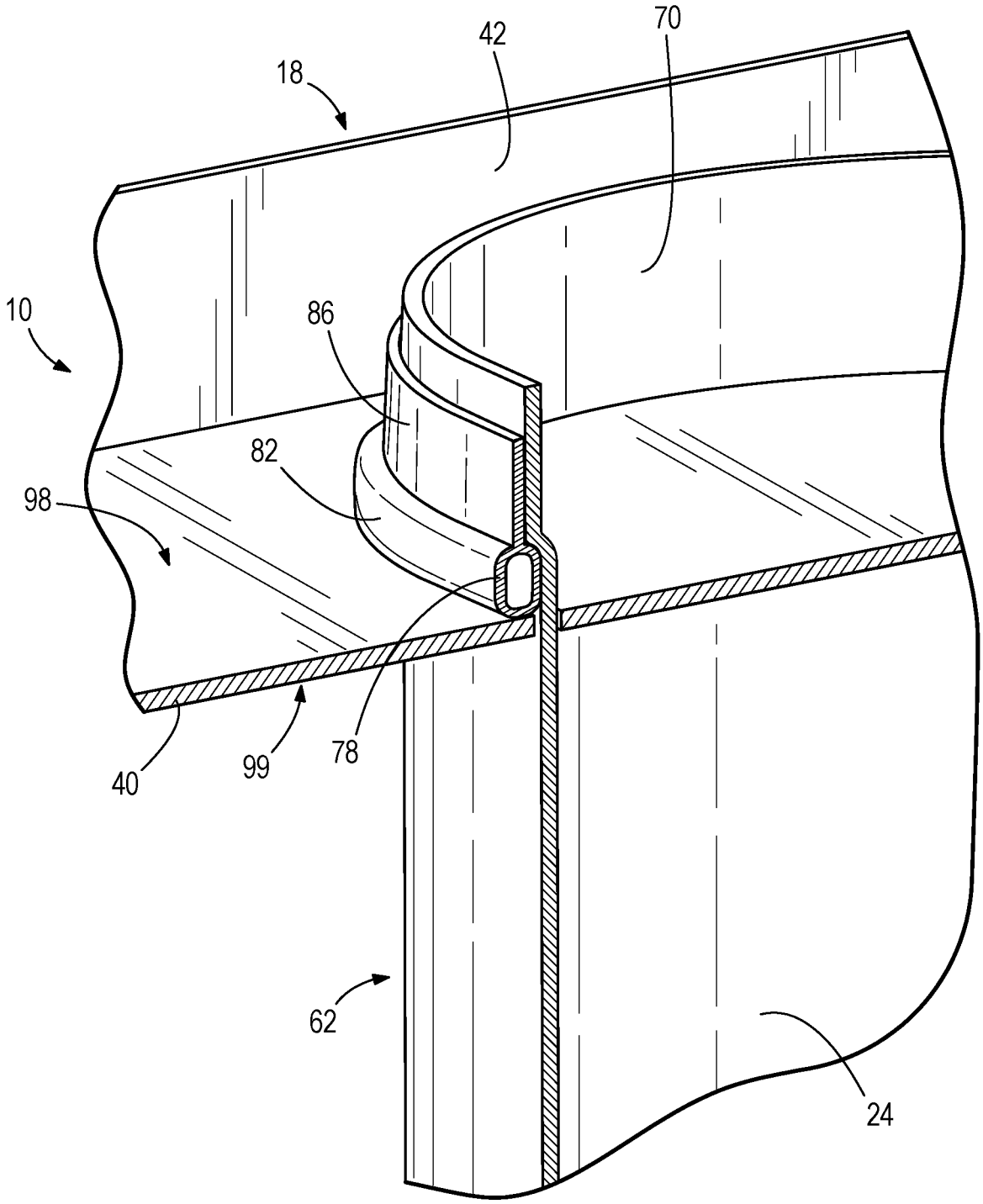
FIG. 4 is a cross-sectional view of the curtain assembly of FIG. 3 with portions removed, taken generally along line 4-4 in FIG. 3.
Figure 5:
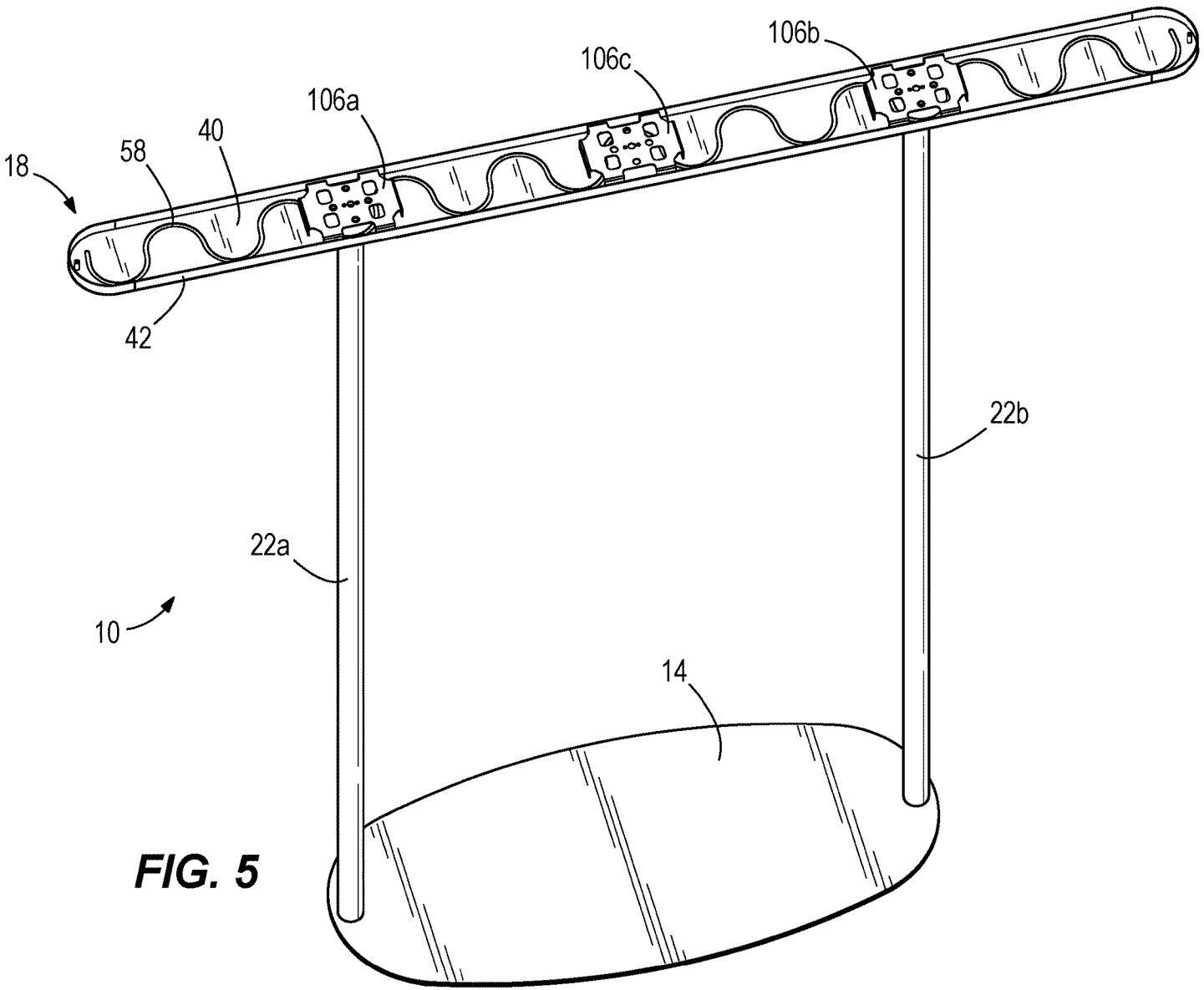
FIG. 5 is a perspective view of the curtain assembly of FIG. 1 with portions removed.
Figure 6:
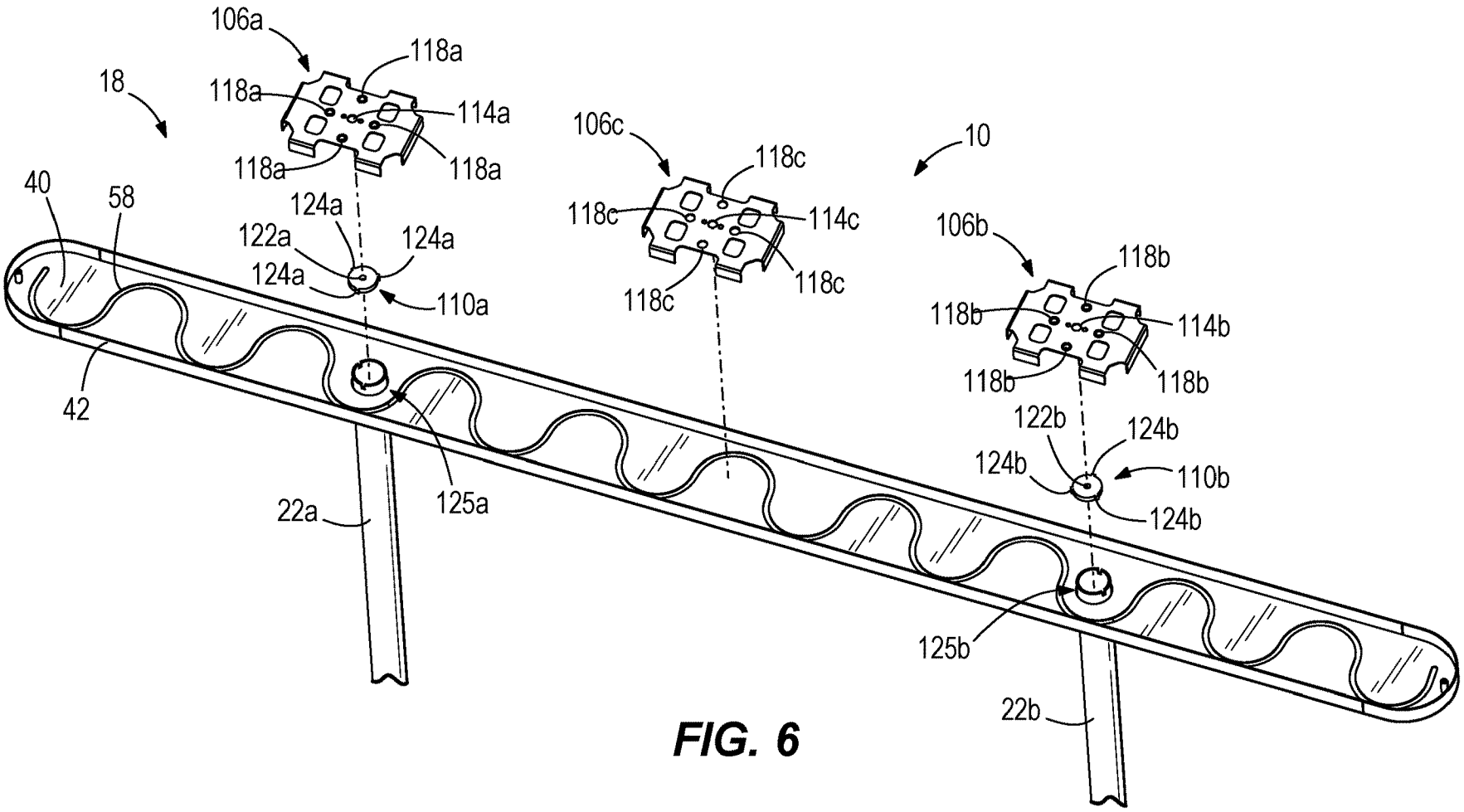
FIG. 6 is an exploded view of the curtain assembly of FIG. 1 with portions removed.
Figure 7:
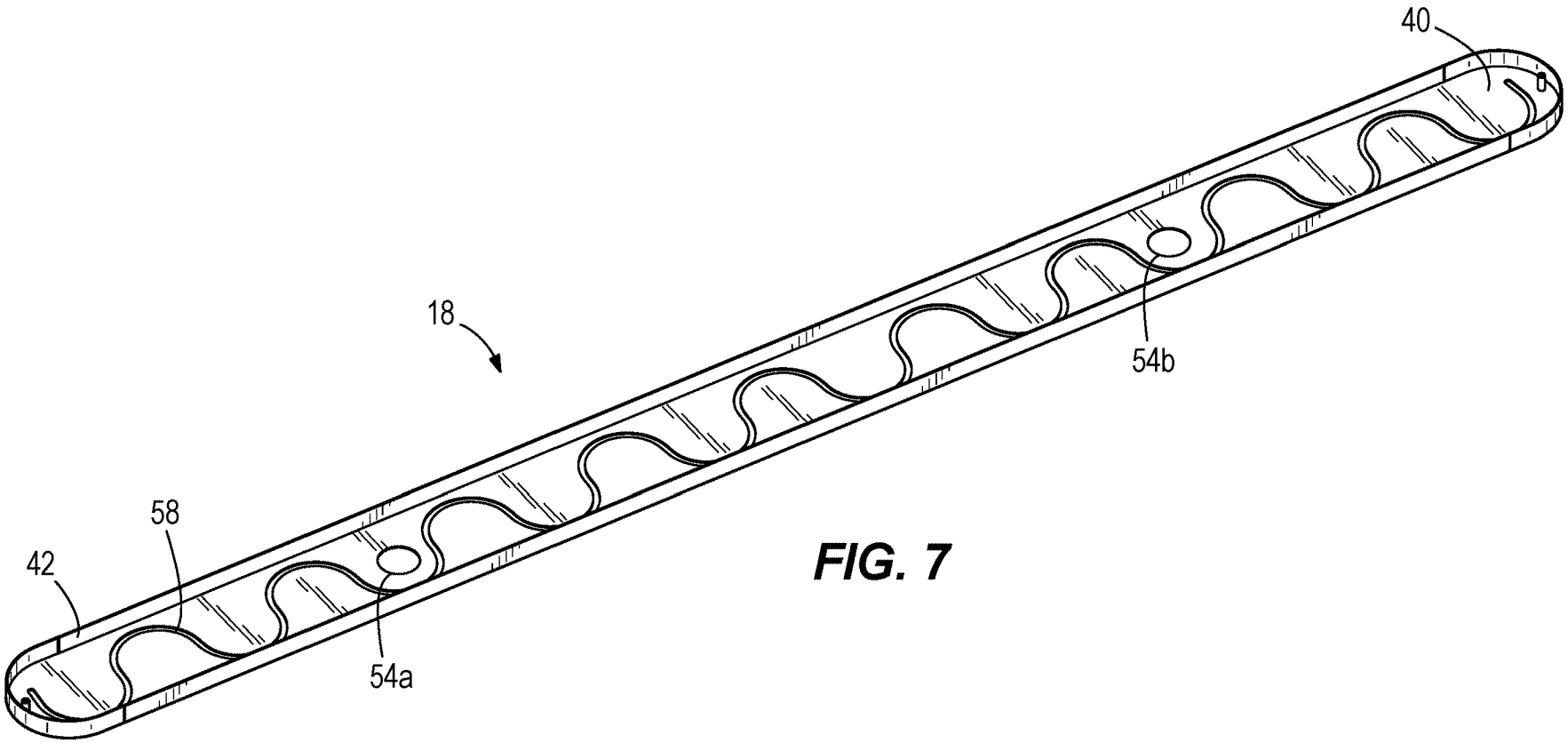
FIG. 7 is a perspective view of a top cap of the curtain assembly of FIG. 1 with portions removed.

After the brace 78 is coupled to the upper edge 70 of the curtain 24, the curtain 24 may then be secured to the top cap 18, as shown in FIG. 4. The upper edge 70 of the curtain 24 is pushed through the slot 58 of the second plate 40, thereby positioning the brace 78 and the curtain 24 within the interior volume of the top cap 18. As the upper edge 70 is pushed through the slot 58, the cylindrical portion 82 may deform (e.g., deflect or squeeze) to fit through the slot 58. The cylindrical portion 82 of the brace 78 is placed along an upper surface 98 of the second plate 40 opposite a lower surface 99 of the second plate 40. The brace 78 is disposed along a side of the slot 58 of the second plate 40, thereby positioning the upper edge 70 of the curtain 24 to align with and extend through the slot 58 and to hang a remaining portion of the curtain 24 from the second plate 40. The cylindrical portion 82 of the brace 78 is larger than the slot 58 of the second plate 40, and therefore inhibits the brace 78 from falling through the slot 58. As such, the brace 78 secures the upper edge 70 of the curtain 24 within the top cap 18 to provide a curtain that is fully untethered from the remaining structure of the curtain assembly 10.

With reference to FIGS. 2, 3, 5, and 6, the curtain assembly 10 further includes a connection assembly configured to couple the first end 26*a*, 26*b* of each vertical support 22*a*, 22*b* to the top cap 18 and couple the second end 30*a*, 30*b* of each vertical support 22*a*, 22*b* to the base 14. The connection assembly includes a plurality of brackets 106 and a first pair of fastener members 110*a*, 110*b*. The plurality of brackets 106 includes a first bracket 106*a*, a second bracket 106*b*, and a third bracket 106*c* disposed between the first and second brackets 106*a*, 106*b*. The plurality of brackets 106 are positioned along the upper surface 98 of the second plate 40. Each bracket 106*a*, 106*b*, 106*c* includes a central hole 114*a*, 114*b*, 114*c* respectively surrounded by a set of holes 118*a*, 118*b*, 118*c*. In the illustrated embodiment, each set of holes 118*a*, 118*b*, 118*c* has four holes. In other embodiments, the set of holes 118*a*, 118*b*, 118*c* can have less than or more than four holes. The central hole 114*a* of the first bracket 106*a* is arranged to coaxially align with the first hole 54*a* of the second plate 40. The central hole 114*b* of the second bracket 106*b* is arranged to coaxially align with the second hole 54*b* of the second plate 40.

Each fastener member 110*a*, 110*b* includes a hole 122*a*, 122*b* and three projections 124*a*, 124*b* radially extending from an external surface of the fastener member 110*a*, 110*b*. The first pair of fastener members 110*a*, 110*b* are configured to be inserted into a respective vertical support 22*a*. 22*b*. When the first pair of fastener members 110*a*, 110*b* are coupled with the vertical supports 22*a*, 22*b*, the projections 124*a*, 124*b* of each fastener member 110*a*, 110*b* are received by corresponding grooves formed in an edge of the first end 26*a*, 26*b* of each vertical support 22*a*, 22*b*.

Multiple fasteners (e.g., screws, bolts, etc.) extend through the first plurality of fastening holes 46 of the first plate 38 and the set of holes 118*a* of the first bracket 106*a*. Additional fasteners extend through the second plurality of fastening holes 50 of the first plate 38 and the set of holes 118*b* of the second bracket 106*b*. As such, the fasteners securely couple the first plate 38 of the top cap 18 to the first and second brackets 106*a*, 106*b*. A pair of fasteners are also provided to be respectively inserted through the central holes of the first and second plurality of fastening holes 46, 50, the central holes 114*a*, 114*b* of the first and second brackets 106*a*, 106*b*, and the holes 122*a*, 122*b* of the first pair of fastener members 110*a*, 110*b* to securely couple the vertical supports 22*a*, 22*b* to the first plate 38 of the top cap 18 and the brackets 106*a*, 106*b*.

As shown in FIG. 2, the connection assembly of the curtain assembly 10 further includes a second pair of fastener members 126*a*, 126*b* having two holes and three projections radially extending from an external surface of each fastener member 126*a*, 126*b*. The second pair of fastener members 126*a*, 126*b* are configured to be inserted into a respective vertical support 22*a*, 22*b*. When the second pair of fastener members 126*a*, 126*b* are coupled with the vertical supports 22*a*, 22*b*, the projections of each fastener member 126*a*, 126*b* are received by respective grooves formed in the second end 30*a*, 30*b* of each vertical support 22*a*, 22*b*.

The base 14 includes a first pair of fastening holes 130, a second pair of fastening holes 134, and a plurality of glides disposed along a bottom surface of the base 14. The first and second pairs of fastening holes 130, 134 are spaced from each other and disposed at opposite ends of the base 14. To securely couple the base 14 to the second end 30*a*, 30*b* of each vertical support 22*a*. 22*b*, the holes of each fastener member 126*a*, 126*b* are to be coaxially aligned with the first and second pairs of fastening holes 130, 134 of the base 14. Fasteners can then be inserted through the first and second pairs of fastening holes 130, 134 of the base 14 and the holes of the second pair of fastener members 126*a*, 126*b*.

Figure 8:
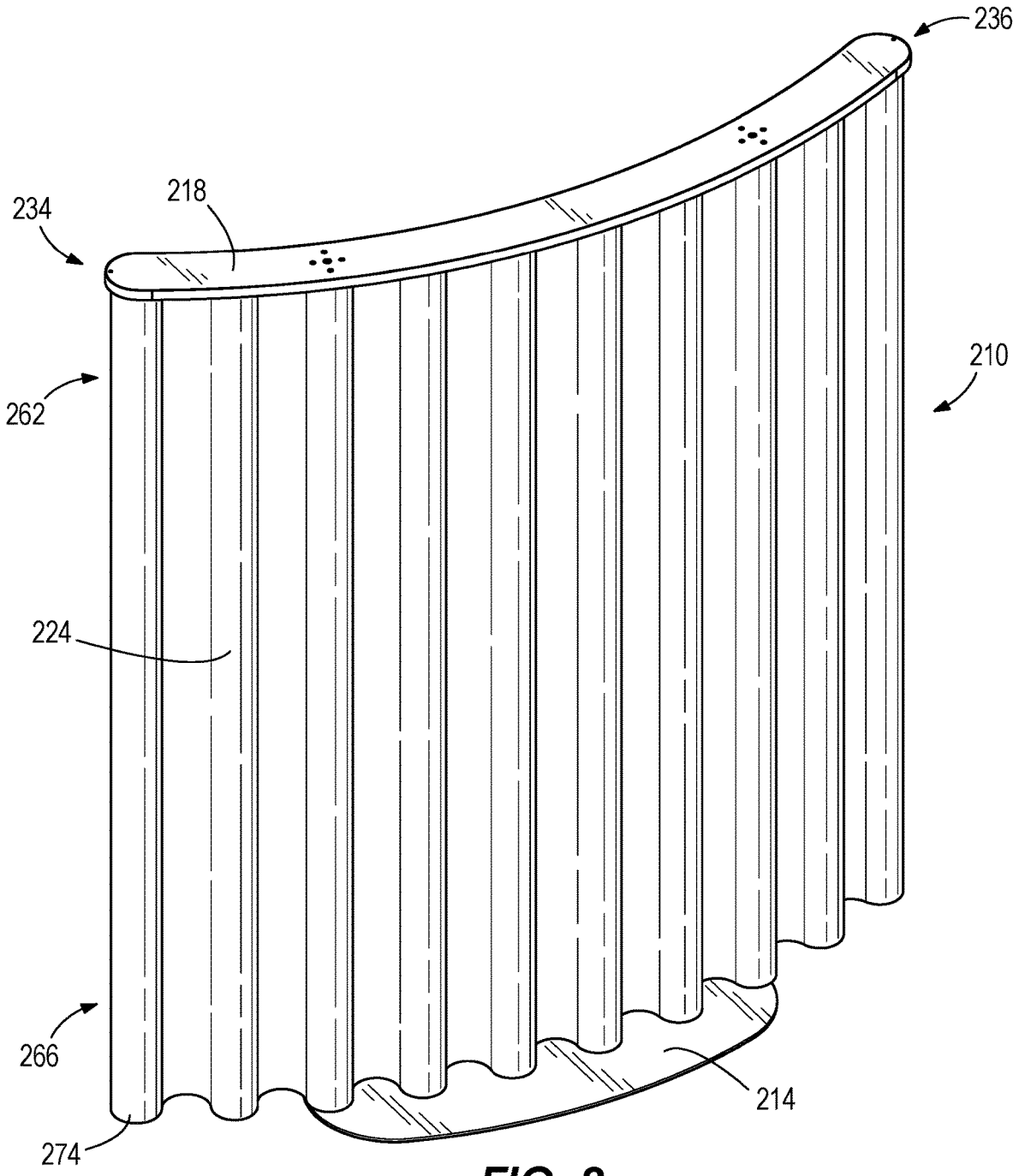
FIG. 8 is a perspective view of a curtain assembly according to another embodiment of the present invention.
Figure 9:
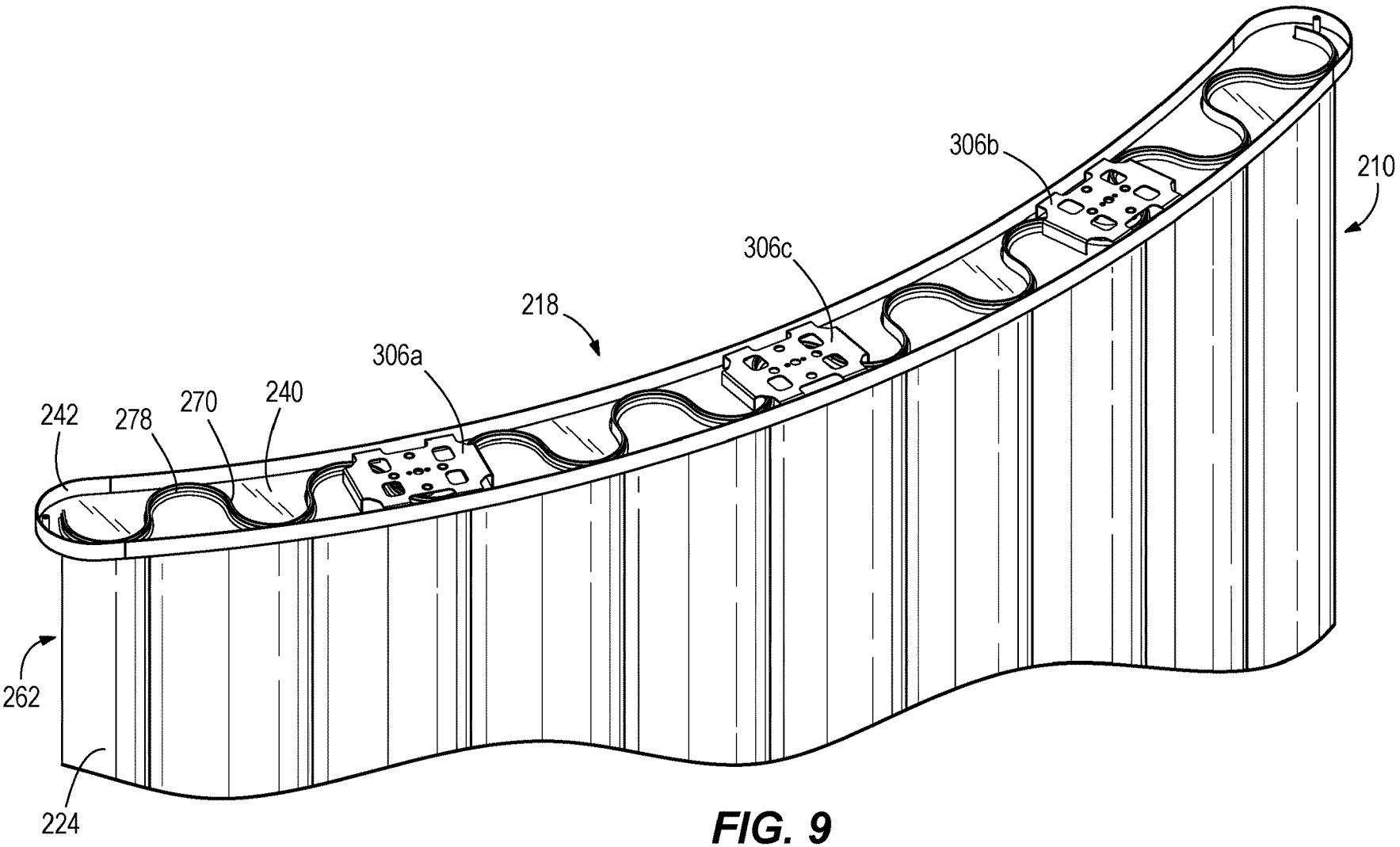
FIG. 9 is an enlarged view of the curtain assembly of FIG. 8 with portions removed.
Figure 10:
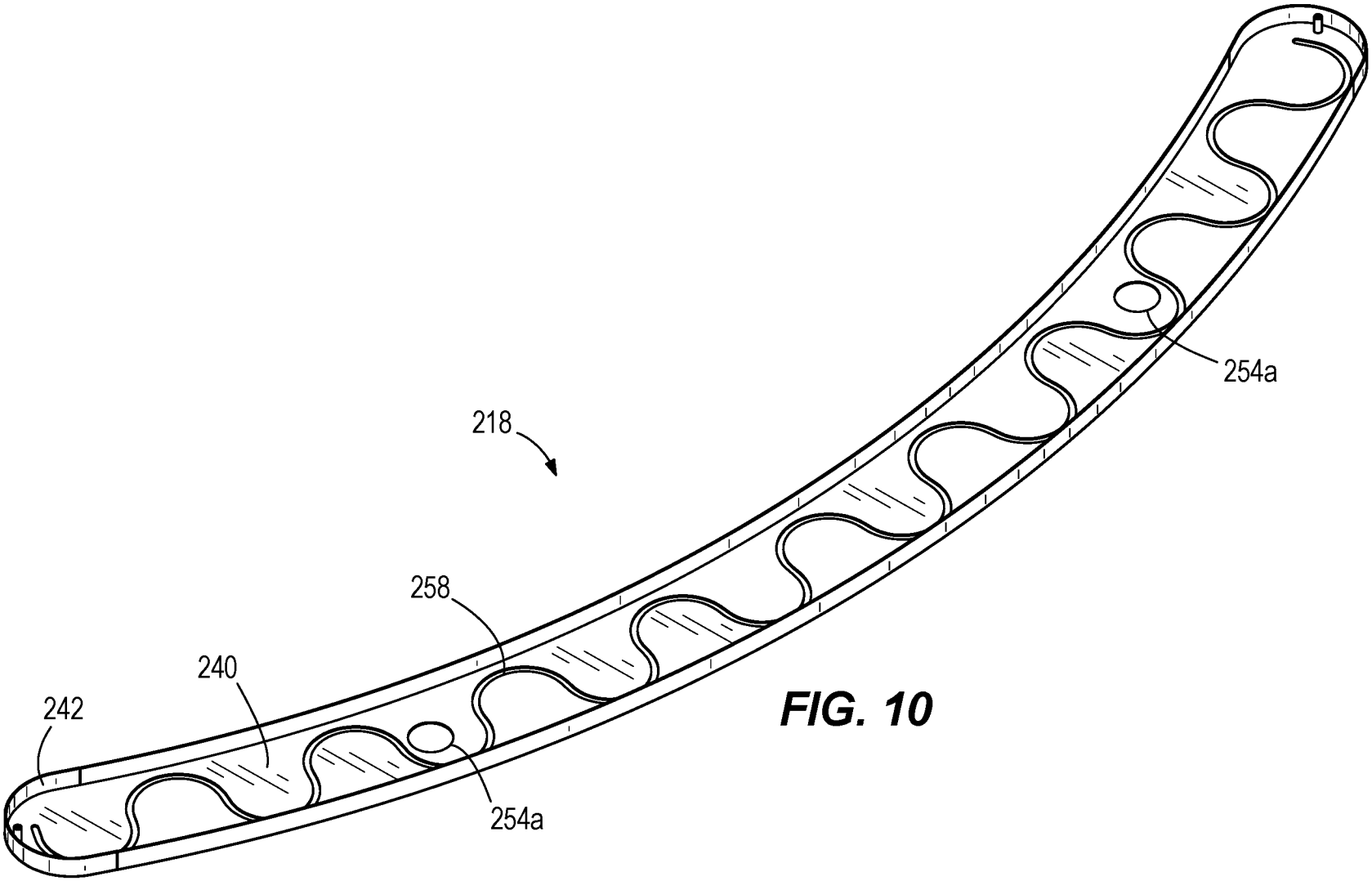
FIG. 10 is a perspective view of a top cap of the curtain assembly of FIG. 8 with portions removed.

FIGS. 8-10 illustrate another embodiment of a curtain assembly 210. The curtain assembly 210 is similar to the curtain assembly 10 of FIGS. 1-7; therefore, like structure will be identified by like reference plus "200." Description of the curtain assembly 10, and alternative thereto, is also applicable to the curtain assembly 210.

The curtain assembly 210 includes a base 214, a top cap 218, a pair of vertical supports, and a curtain 224. The curtain assembly 210 further includes a brace 278 configured to secure the curtain 224 within the top cap 218. Unlike the curtain assembly 10, the top cap 218 of the curtain assembly 210 has a curvilinear shape.

Each of the curtain assemblies 10, 210 has a height and a width. The heights of the curtain assemblies 10, 210 range between 60 inches and 86 inches, and are preferably 75 inches. The widths of the curtain assemblies 10, 210 range between 48 inches and 72, and are preferably 68 inches. In other embodiments, the curtain assemblies 10, 210 may have other dimensions The curtain assemblies 10, 210 can be utilized in professional settings and educational settings to serve as partitions. As such, the curtain assemblies 10, 210 are configured to separate different portions of indoor spaces, thereby defining boundaries of smaller working spaces. In other embodiments, the curtain assemblies 10, 210 can be utilized in residential settings. Due to the structure of the curtain assemblies 10, 210, the curtain assemblies 10, 210 may be easily repositionable without the need for disassembling the curtain assemblies 10, 210.

Since the top cap 18 of the curtain assembly 10 has a linear shape, the curtain assembly 10 is to be placed around furniture with a corresponding linear shape. In particular, the curtain assembly 10 may be placed around office desks, conference tables, chairs, and couches. Since the top cap 218 of the curtain assembly 210 has a curvilinear shape, the curtain assembly 210 may be placed around furniture with curvature. As such, the curtain assembly 210 may be placed around round tables, chairs, and couches.

Various features and advantages of the invention are set forth in the following claims.

What is claimed is:

1. A curtain assembly comprising:

a vertical support;

a top cap coupled to the vertical support and defining an interior volume, the top cap including a first end, a second end opposite the first end, and a plate, the plate having an upper side at least partially defining the interior volume, a lower side opposite the upper side, and a slot extending at least partially between the first and second ends; and a curtain including an upper edge extending through the slot of the plate such that the upper edge is positioned within the interior volume of the top cap, the curtain also including a lower portion hanging from the plate, wherein the vertical support is coupled to the top cap at a location between ends of the slot, and wherein the lower portion of the curtain overlaps at least a portion of the vertical support.

2. The curtain assembly of claim 1, further comprising a brace coupled to the upper edge of the curtain and positioned above the upper side of the plate to secure the curtain to the top cap.

3. The curtain assembly of claim 2, wherein the brace is an extrusion.

4. The curtain assembly of claim 1, wherein the slot is non-linear.

5. The curtain assembly of claim 1, wherein the top cap has a linear shape.

6. The curtain assembly of claim 1, wherein the top cap has a curvilinear shape.

7. The curtain assembly of claim 1, further comprising a base coupled to the vertical support, and wherein the base is disposed opposite the top cap such that the vertical support is disposed between the base and the top cap.

8. The curtain assembly of claim 7, wherein the vertical support is a first vertical support, and wherein the curtain assembly further comprises a second vertical support coupled to the base and the top cap such that the second vertical support is disposed between the base and the top cap.

9. A curtain assembly comprising:

a vertical support;

a top cap coupled to the vertical support, the top cap including a first end, a second end opposite the first end, and a slot extending at least partially between the first and second ends;

a curtain including an upper edge extending through the slot of the top cap and a lower portion hanging from the top cap; and a brace coupled to the upper edge of the curtain and positioned within the top cap to secure the curtain to the top cap and hang the lower portion of the curtain from the top cap, at least a portion of the brace configured to deform when inserted through the slot to fit through the slot and be positioned within the top cap.

10. The curtain assembly of claim 9, wherein the slot is non-linear.

11. The curtain assembly of claim 9, further comprising a base coupled to the vertical support, and wherein the base is disposed opposite the top cap such that the vertical support is disposed between the base and the top cap.

12. The curtain assembly of claim 9, wherein the top cap has a linear shape.

13. The curtain assembly of claim 9, wherein the top cap has a curvilinear shape.

14. The curtain assembly of claim 9, wherein the brace is an extrusion.

15. The curtain assembly of claim 9, wherein the brace includes an enlarged portion and a narrow portion extending from the enlarged portion, and wherein the enlarged portion inhibits the brace from falling through the slot.

16. A curtain assembly comprising:

a base configured to be placed on a surface and support the curtain assembly;

a vertical support having a first end and a second end opposite the first end, the second end being coupled to the base;

a top cap coupled to the first end of the vertical support and defining an interior volume, the top cap including a first plate, a second plate spaced from the first plate, and an outer periphery coupled to and disposed between the first plate and the second plate to define the interior volume, the second plate having a slot with an undulating configuration in a horizontal direction; and a curtain including an upper edge extending through the slot of the second plate such that the upper edge is positioned within the interior volume of the top cap, the curtain also including a lower portion hanging from the second plate.

17. The curtain assembly of claim 16, further comprising a brace coupled to the upper edge of the curtain and positioned above the second plate to secure the curtain to the top cap.

18. The curtain assembly of claim 16, wherein the top cap has a linear shape.

19. The curtain assembly of claim 16, wherein the top cap has a curvilinear shape.

20. The curtain assembly of claim 16, wherein the vertical support is a first vertical support, wherein the curtain assembly further comprises a second vertical support including a first end and a second end, and wherein the top cap is coupled to first end of the second vertical support and the base is coupled to the second end of the second vertical support such that the second vertical support is disposed between the base and the top cap.

* * * * *